US006802197B2

(12) United States Patent
Barrera

(10) Patent No.: US 6,802,197 B2
(45) Date of Patent: Oct. 12, 2004

(54) PROCESS FOR MANUFACTURING A HIGH STRENGTH CONTAINER, PARTICULARLY AN AEROSOL CONTAINER, AND THE CONTAINER OBTAINED THROUGH SUCH PROCESS

(76) Inventor: María Eugenia Barrera, Larsen 2339 (1419), Federal Capital (AR)

( * ) Notice: Subject to any disclaimer, the term of this patent is extended or adjusted under 35 U.S.C. 154(b) by 0 days.

(21) Appl. No.: 10/339,736

(22) Filed: Jan. 8, 2003

(65) Prior Publication Data

US 2003/0159488 A1 Aug. 28, 2003

(30) Foreign Application Priority Data

Jan. 9, 2002 (AR) ..... P 02 01 00055

(51) Int. Cl.[7] ..... B21C 23/18

(52) U.S. Cl. ..... 72/267; 72/41; 72/379.4; 72/715; 220/604

(58) Field of Search ..... 220/604, 608, 220/609; 72/372.4, 256, 267, 715, 40, 41, 42

(56) References Cited

U.S. PATENT DOCUMENTS

| | | | | |
|---|---|---|---|---|
| 3,029,507 A | * | 4/1962 | Gaggini | 72/254 |
| 3,372,844 A | | 3/1968 | Kitabayashi | |
| 3,443,411 A | * | 5/1969 | Anthony | 72/267 |
| 4,029,232 A | | 6/1977 | Mania | |
| 4,078,508 A | * | 3/1978 | Schertenleib | 72/256 |
| 4,185,749 A | | 1/1980 | Vartia | |
| 4,200,051 A | * | 4/1980 | Nakahara et al. | 72/283 |
| 4,876,868 A | * | 10/1989 | Tushaus et al. | 72/42 |
| 4,889,709 A | | 12/1989 | Mackles et al. | |
| 4,938,260 A | | 7/1990 | Hirz | |
| 5,362,341 A | | 11/1994 | Palmer et al. | |
| 5,572,893 A | * | 11/1996 | Goda et al. | 72/254 |
| 5,676,512 A | | 10/1997 | Diamond et al. | |
| 5,704,513 A | | 1/1998 | Diamond et al. | |
| 6,026,981 A | | 2/2000 | Thizy et al. | |
| 6,547,503 B1 | | 4/2003 | Bumlohm et al. | |

FOREIGN PATENT DOCUMENTS

| | | |
|---|---|---|
| DE | 4302446 | 8/1994 |
| EP | 0127212 | 12/1984 |
| EP | 1064413 | 7/1999 |
| EP | 1129952 | 7/2001 |
| EP | 1153849 | 11/2001 |
| FR | 2543923 | 10/1984 |
| FR | 2709081 | 2/1995 |

(List continued on next page.)

*Primary Examiner*—Ed Tolan
(74) *Attorney, Agent, or Firm*—Thorpe North & Western

(57) ABSTRACT

A process for shaping a high strength container, particularly an aerosol container and a container obtained through such process. Generally, aerosol containers made of aluminum or tin are obtained by conventional embedding processes from sheet disks and have cylindrical bodies with upper tapering finishing at a curl for fixing a valve cover and are closed by convex and profiled cross section bottoms, for forming a support region for upstanding the container. The bottom of such containers is obtained before tapering by means of a blow or front shock once the cylindrical body having planar circular base is shaped, this impact causing undesirable stresses on the body side wall and material accumulation at the annular region joining with this wall since the bottom thickness is not uniform. The invention proposes a process for shaping this kind of containers by extrusion thus saving material as a consequence of imparting the container with thin walls due to a substantial change in the production concept, giving concave shape to the base for avoiding undesirable stresses on side wall during further production steps and saving material at the joints with the side wall. The invention also relates to a particular shape container, having no material accumulation at the concave bottom, which may be used in different positions, horizontal or vertical aided by plastic or metal accessories.

7 Claims, 1 Drawing Sheet

FOREIGN PATENT DOCUMENTS

| | | |
|---|---|---|
| FR | 2807057 | 10/2001 |
| JP | 53050514 | 5/1978 |
| JP | 57032350 | 2/1982 |
| JP | 6116673 | 4/1994 |
| JP | 6116674 | 4/1994 |
| JP | 7102338 | 4/1995 |
| JP | 8060279 | 3/1996 |
| JP | 8134612 | 5/1996 |
| JP | 10121179 | 5/1998 |
| JP | 2000008133 | 1/2000 |
| JP | 2000144291 | 5/2000 |
| JP | 2000144353 | 5/2000 |
| JP | 2001032057 | 2/2001 |
| JP | 2001073058 | 3/2001 |
| JP | 2002212691 | 7/2002 |
| WO | PCT/US94/11219 | 4/1996 |
| WO | WO01/64965 | 9/2001 |

* cited by examiner

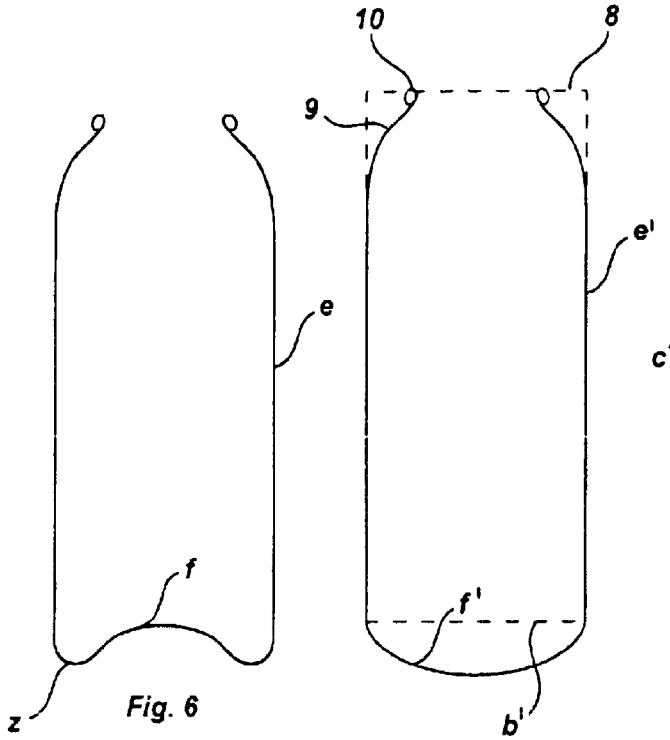
Fig. 6
Fig. 3
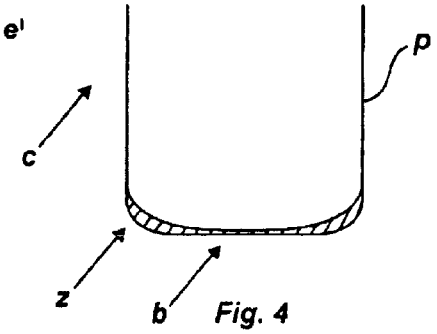
Fig. 4
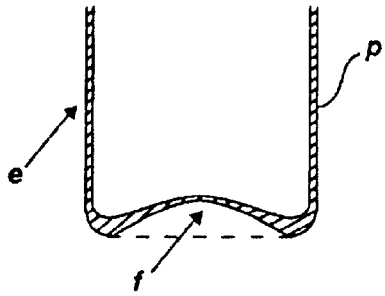
Fig. 5
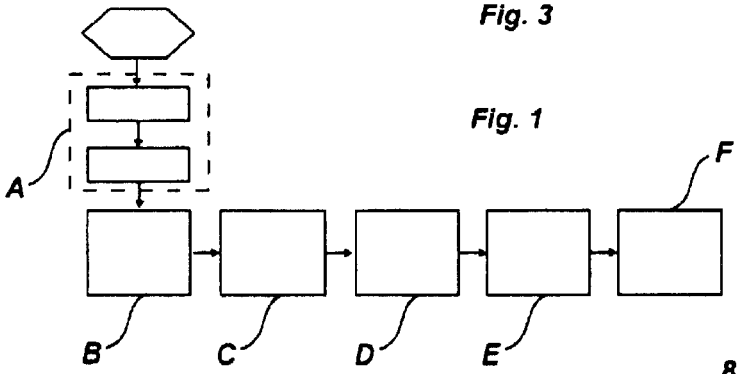
Fig. 1
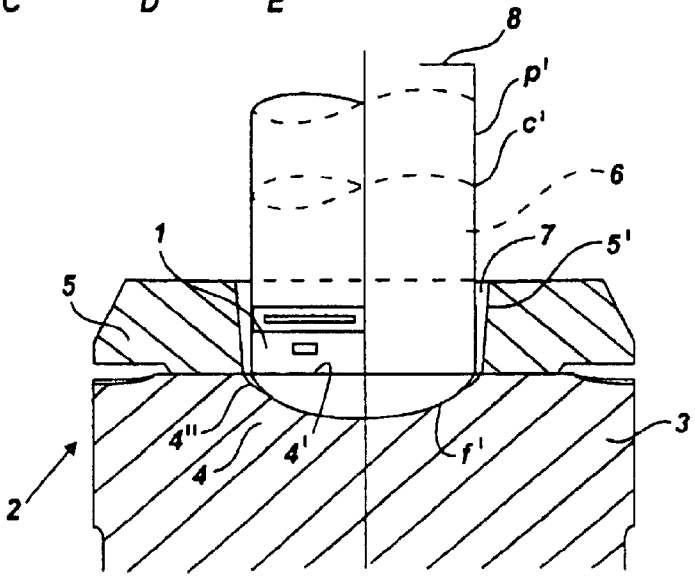
Fig. 2

PROCESS FOR MANUFACTURING A HIGH STRENGTH CONTAINER, PARTICULARLY AN AEROSOL CONTAINER, AND THE CONTAINER OBTAINED THROUGH SUCH PROCESS

This application claims priority of Argentina Application No. P 02 01 00055 filed Jan. 9, 2002 in the Republic of Argentina Patent Office.

FIELD OF THE INVENTION

The instant invention relates to a process for manufacturing a high strength container, particularly an aerosol container, and to a container obtained by such process.

The main object of the invention is a process for shaping aerosol containers from an aluminum disk, affording novel features due to a substantial change in the production concept for shaping a cylindrical hollow body, of planar circular base, from a deformation of the latter by high speed impact pressing at room temperature which allows, within a die, the cold extrusion of the disk material, the material flowing in a direction opposite to that of disk pressing.

Another object of the invention is a process allowing savings in the container material, by a change of the shape at the lower portion or base of the cylindrical body in order to afford high inner pressure strength with a uniform thickness to the side wall as well as to said base or bottom, this being attained during the material extrusion caused by the disk pressing.

Another object of the invention is a process for obtaining a cylindrical hollow body by pressing the aluminum disk material allowing the shaping of a low thickness bottom, without material concentration at the joint with the container side wall, thus eliminating unnecessary further stresses to which containers are subjected to during the further step of forming the convex traditional bottom.

Still another object of the invention is a process for obtaining a lower cost container due to material savings and easy to manufacture in conventional production lines, having high pressure strength and allowing, due to the bottom shape, a different exposition due to its concave bottom.

Finally, a further object of the invention is a container obtained through the mentioned process, having a concave bottom, a uniform wall thickness and high inner pressure strength due to a particular way of distributing stresses.

Prior Art

Various products are known which are packaged with a pressurized gas to be transferred in a spray form through a valve device operated by hand and incorporated to the container. Among them, the so-called aerosols are of widespread use and generally have cylindrical similar shapes with valve devices provided with pulsators at the top and mounted on a closing cover of the cylindrical container, made of sheet metal material and having a characteristic convex support base and the most prominent contour directed towards the upper side of the virtual planar base of the cylindrical container.

This convex shape has been maintained in this kind of containers for pressurized products, such as aerosols, since they have at the base a perimetral edge or region for supporting the container firmly, and establishes an increase in the surface for affording a higher resistance to the pressure inside the containers.

Manufacturing of containers is carried out conventionally by embedding, particularly of aluminum or tin metal sheets or disks in dies whose shape and diameter correspond to the shape of the final part, which for aerosols are cylindrical with planar circular base. In conventional embedding operations a male forcing the metal disk inside the die is used so as to obtain the desired shape. Following this conventional embedding operation in present production lines, the planar circular base cylindrical parts are subjected to successive finishing steps, among them the shaping of a convex bottom, a tapered shape at the top and a curl for fixing the valve device (FIG. 6).

The conventional step of preparing the convex bottom is carried out by means of a punch frontal blow, thus attaining the desired bottom transverse profile, which deforms the planar base of the cylindrical body according to the vertical axis thereof. FIG. 5 shows schematically a container (e) of this kind, upon termination of the shaping steps and shows a conventional bottom (f) allowing the vertical support of the container.

Deformation of the disk or plate during the embedding operation for obtaining the circular base (b) cylindrical body (c) determines an improper distribution of material in said base (b), as may be seen in FIG. 4, with higher material accumulation at the annular and perimetral region (z) of the base (b) and the rear frontal blow for shaping the convex bottom (f) causing that the side walls or wall (p) of the body (c) support this stress, particularly when the material is aluminum. Material distribution once the bottom (f) is formed by means of a frontal blow is not homogeneous as may be seen in FIG. 6.

The following is a table including percentages corresponding to containers of different diameters and heights indicating the concentration in said bottom (f) so as to have an idea of the material distribution in aluminum containers when these are manufactured with conventional methods or processes:

| DIAMETER | % at the bottom |
|---|---|
| 35 × 140 | 17% |
| 45 × 125 | 26% |
| 50 × 133 | 25% |
| 50 × 155 | 20% |
| 53 × 110 | 28% |
| 58 × 165 | 30% |
| 58 × 183 | 21% |
| 58 × 224 | 17% |
| 66 × 143 | 30% |
| 66 × 180 | 25% |

SUMMARY OF THE INVENTION

In order to obtain an aerosol high strength container allowing a different stress distribution, high inner pressure resistance and material savings, the instant invention proposes a process for shaping this kind of containers including, as main feature, forming a cylindrical hollow body having a concave base projecting outside the body thus attaining a higher resistance to strain pressure.

With the proposed process a container as mentioned is obtained, wherein 85% of the direct manufacturing costs are related to aluminum, savings of 30% in connection with the material, which means, approximately, a saving of 25% in the costs of the container.

The process for carrying out the steps of deforming the disk for its extrusion requires the inclusion of prior treatment of the disk in order to obtain good pressing and extrusion thereof and further incorporating the conventional steps of turning and surface treatment of the hollow body obtained through extrusion for it further coloring and labeling, as well as for its tapering and forming the curl for fixing the valve cover.

The invention also relates to the container obtained with the above process. The main features of the container are its low thickness and its change in the bottom shape, implying high resistance to internal pressure. Further, as a consequence of the shape change, the appearance of the container is different from the conventional position, such as support cover or accessories allowing its horizontal positioning.

Finally, the advantages of the container obtained through the process of the invention are: a) savings in aluminum material and lower cost; b) manufacture in conventional production lines; c) higher capacity of the container and reduced costs; d) the change in shape allows subjecting the container to lower stresses during manufacturing allowing reduced thickness of its wall, and e) easy application of internal coatings.

BRIEF DESCRIPTION OF THE DRAWINGS

FIG. 1 is a diagram of the different steps constituting the process for shaping a high resistance aerosol container, main object of the invention.

FIG. 2 is a schematic cross section of the die for partial shaping of the container obtained through the process of the invention, allowing extrusion of the material and shaping of the hollow cylindrical body with a circular planar base.

FIG. 3 is a cross section and elevation of the high resistance container with concave bottom and uniform thickness of the walls, obtained by extrusion with the process of the invention.

FIGS. 4, 5 and 6 show, in cross section, different steps for making a conventional container.

DESCRIPTION OF A PREFERRED EMBODIMENT OF THE INVENTION

Referring to the drawings, the steps of the process for shaping a high resistance container (e'), as that shown in FIG. 3 are shown in the block diagram of FIG. 1.

For practicing said process a circular aluminum disk 1 is used, the diameter and thickness of which are dimensioned according to the material required for obtaining the container (e') of FIG. 3, i.e., according to a determined volume of material to make the walls of the container (d') by means of extrusion. Disk 1 is partially shown in FIG. 2 and into the die, designated with general reference 2.

Aluminum disks 1, according to the process, should be surface treated in a first step of the process, as shown in FIG. 1, for facilitating operation of the tools of die 2. This first step, indicated with reference (A) in FIG. 1, includes the step of granulating disk 1 and then surface lubrication thereof, the granulating step resulting in an increase of the surface roughness of the disk 1 for a better adherence of the lubricating substance.

The step of granulating disks 1 is carried out placing them into a hexagonal section drum within which baffles are distributed for blowing disks 1. Drum (not shown) rotation during a predetermined period of time and the constant shock against baffles produce roughness on the disk surface and powder from them is exhausted through openings at the drum wall. Within said process step (A), the lubricating step comprises covering disks 1, already granulated, with a thin and homogeneous layer of solid lubricant for facilitating the extrusion process indicated herein.

According to the proposed process, disks treated in step (A) are passed to step (B), which includes the steps of pressing disks 1 and turning the obtained part by extrusion.

The pressing step is carried out with a die 2 such as that constituted by a bottom or base 3 with a firm steel support, which has a circular upper recess 4 limiting a space having a height corresponding to the bottom (f') thickness of the container (e'), with a planar circular surface 4' engaging a peripheral edge 4" curved as per a circle arch, this space serving as a support for disk 1.

Die 2 comprises, superimposed to the lower portion or base 3, a fixed ring, also made of steel, having a central coaxial opening 5' and mating with the upper recess 4 of the lower portion 3, the lower part and the ring 5 being coaxially mating with punch 6, the diameter of which is slightly smaller than the diameter of the central opening 5' of ring 5 to allow flowing of the disk 1 material, as will be seen.

This pressing step is carried out placing a disk 1 in the upper recess 4 of the lower portion 3 through ring 5 of the die 2, at this time being effected an alternative and high speed displacement of punch 6 against 1 for impact pressing thereof. This constant impact of punch 6 against disk 1 confined in the upper recess 4 and in opening 5' of ring 5 produces the extrusion of the disk 1 aluminum material, due to flowing thereof in a direction opposite to the base of punch 6 and through the free space 7 between the punch and the wall of the central opening 5' of ring 5.

Cold extrusion allows obtaining or shaping a bottom (f') and a side wall (p') for making the container (e') thin and uniform and without material accumulation at the joining region between the bottom and the side wall as conventionally occurs, this extrusion resulting in a cylindrical hollow part (c') with concave base (f") FIG. 2 shows the punch 6 in its operating positions before initiating pressing of the disk 1 and after effecting extrusion via repetitive impact. Thus, the bottom is uniform and thin, eliminating material accumulation such as is the case with conventional containers.

Turning stage of process step (B) is effected due to the fact that the body or part (c') has an irregular upper mouth 8, in what concerns to its perimetral profile due to the material extrusion process during disk pressing 1, and the object of turning is to cut irregular parts to obtain a perfect hollow cylindrical part (c'). Equipment used for effecting turning (c') is a lathe with pins provided with slots for maintaining height reference of the containers and with a blade cutting material excess from mouth 8 of part (c') along the circumference thereof (this equipment is merely an example and it is not shown since another alternatives may be used to this end).

As shown in the block diagram of FIG. 1, the cylindrical hollow part (c') having a circular base (b) is subjected, in step (C) to a conventional washing to remove lubricant applied to the disk 1 prior pressing and turning, thus preparing the surface of he cylindrical hollow part body (c') for the application of surface coatings on the walls thereof.

These conventional coatings begin in practice during step (D) of the process wherein inner protection is given to the hollow cylindrical part (c') by means of varnishing. To this end, parts (c') are positioned on rotating cups and coated by means of a varnishing gun with a layer of pressure varnish preventing that the product to be filled into the container be affected by aluminum.

Upon finishing inner varnishing of hollow parts (c'), the next step (E) of the process of the invention is effecting the conventional enameling of the outer walls of cylindrical hollow parts (c') for providing a base for further application of inks. This step is finished passing the pieces through an oven for drying enamel and removing solvents.

Hollow cylindrical parts (c') are subjected also to conventional lithography during step (E) for printing logos, colors, etc. on the previously enameled hollow body (c'), as required by the customer for the product to be marketed, this step (E) being completed by overprinting and conventional lacquering to afford chemical and physical outer strength to the already lithographed cylindrical parts (c') so that they may resist overflow during filling of the containers.

Once surface treatment of the cylindrical hollow parts (c') obtained by extrusion (B), they are subjected, in step (F), to a finishing step of shaping cylindrical parts (c'), particular in a sequential manner, and the shoulder (9) and curl (10) of the upper parts with their turned (B) are formed.

Hollow parts (C') already treated and with concave bottom are then tapered at the top for forming therein a shoulder 9 and a curl 10 for the closing cover, this being carried out with conventional dies.

The container obtained through the process of the invention has a shape different to those known since the concave bottom, apart from affording higher resistance to the internal pressure, may only be exposed horizontally or, through plastic accessories, in a vertical manner.

What is claimed is:

1. A method for shaping a high strength container, and particularly an aluminum aerosol container, said method comprising:

obtaining a disk having a given volume of malleable material and a surface;

subjecting said surface of said disk to a surface treatment;

placing said disk inside a die configured for extruding said disk;

deforming said disk by impact pressing within a die to obtain a thin-walled hollow cylindrical body having a formed concave base projecting outside said body, a sidewall, and an upper circular mouth, said base and said sidewall comprising a uniform thickness throughout; and tapering said upper circular mouth to form a shoulder having a curl configured to affix a valve cover capable of closing said body, thus forming a container having a high resistance to internal pressure and comprising no material accumulations at the junction between said base and said side walls, but rather a homogenous material distribution.

2. A high resistance container obtained by the process claimed in claim 1, of the kind comprising:

a cylindrical body formed by an impact extrusion process and having a concave base, a sidewall, and a tapered upper portion, said concave base configured to resist and support an internal pressure, said tapered upper portion forming a shoulder with a curl;

a valve cover affixed to said curl to form a pressure support container, said pressure support container having a uniform thickness between said concave base and said side wall without material accumulation at their junction.

3. The method of claim 1, wherein said subjecting comprises granulating said surface of said disk to obtain a granulated surface.

4. The method of claim 3, wherein said deforming comprises:

placing said disk into a die having a ring adjacent said die, said ring comprising an opening slightly larger than the diameter of said punch;

impacting said punch against said disk to extrude said material and obtain said hollow cylindrical body, said material extruding in a direction opposite that of said punch advancement and through an annular space created by said ring and said punch.

5. The method of claim 3, wherein said applying is selected from the group consisting of a varnishing, a lacquering, enameling, and lithographing.

6. The method of claim 1, further comprising:

removing unwanted material from said cylindrical body;

cleaning said body to remove any lubricants following said step of deforming; and applying one or more surface treatments to said body to create a finished look.

7. The method of claim 1, wherein said die comprises:

a support base having a circular upper recess formed therein defining a space having a height corresponding to a desired thickness of said concave bottom;

a planar circular surface engaging a peripheral edge curved to comprise an arch, thus functioning as a support for said disk; and a fixed ring superimposed with said support base and having a central coaxial opening that mates with said upper recess of said support base, said support base and said ring also mating coaxially with a punch having a diameter slightly smaller than a diameter of said central coaxial opening to allow flowing of the material of said disk.

* * * * *